United States Patent [19]

Forsyth

[11] 4,037,835

[45] July 26, 1977

[54] STABILIZING MEANS FOR TRAMPOLINE

[76] Inventor: Roland W. Forsyth, Box 717, Decatur, Ga. 30032

[21] Appl. No.: 597,015

[22] Filed: July 18, 1975

[51] Int. Cl.[2] ..... A63B 5/18

[52] U.S. Cl. ..... 272/65; 52/292; 248/346

[58] Field of Search ..... 52/300, 292; 248/44, 248/310, 346; 272/65

[56] References Cited

U.S. PATENT DOCUMENTS

| | | | |
|---|---|---|---|
| 826,996 | 7/1906 | Cooke | 52/292 |
| 2,086,009 | 7/1937 | Walker | 52/292 |
| 2,689,705 | 9/1954 | Ciaccio | 248/346 |
| 3,831,936 | 8/1974 | Watson et al. | 272/65 |

*Primary Examiner*—Richard J. Apley
*Assistant Examiner*—William R. Browne
*Attorney, Agent, or Firm*—Jones, Thomas & Askew

[57] ABSTRACT

Stabilizing means for a trampoline having a frame and a plurality of legs supporting the frame, comprising a shoe for receiving the foot of each of the legs, the shoe including stops to prevent lateral motion of the foot with respect to the shoe, and including anchoring means to prevent motion of the shoe with respect to the ground or other surface.

2 Claims, 3 Drawing Figures

STABILIZING MEANS FOR TRAMPOLINE

This invention relates to trampolines and the like and is more particularly concerned with stabilizing apparatus for the supporting structure of a trampoline.

Trampolines are customarily constructed by providing a generally rectangular frame to support the mat through the medium of a plurality of springs, and the rectangular frame is usually supported from a plurality of legs. Since, in the course of use of a trampoline a person is on the mat while the mat is caused to extend well below the rectangular frame, it is obvious that the frame must be supported in such manner that a person using the trampoline will not engage structural framework even well below the rectangular frame that supports the mat. This requirement results in designs for trampolines wherein the rectangular framework is strengthened in an effort to provide enough support to prevent undue flexing of the framework because it is hazardous to place structure below the framework or above the framework.

While trampolines have been made, and have achieved a wide popularity, using a rectangular frame that is simply reinforced substantially in the plane of the frame, there is still a difficulty in that the frame flexes, especially in its longer dimension, which causes two primary problems. One of the problems is that the flexing of the frame tends to weaken the frame, and the other problem is that the flexing of the frame causes the legs to move alternately out and back which tends to scratch the surface on which the trampoline is standing. If the trampoline is standing on the ground, the constant motion of the legs will dig a hole in the ground which will make the trampoline unsteady, and of course badly mar the lawn or the like on which the trampoline may be placed.

The apparatus of the present invention overcomes the above mentioned and other problems by providing a stabilizing means for the legs of a trampoline, the stabilizing means including a plurality of shoes, each of the shoes including a substantially rigid supporting plate for supporting a leg of the trampoline, the supporting plate including retaining means fixed thereto to prevent lateral movement of a leg with respect to the supporting plate. The apparatus further includes means for fixing the supporting plate in a given location. In the case of a trampoline that is to be used on the ground, the means to prevent motion of the supporting plate can take the form of one or more pegs or the like to be inserted into the ground; however, if the supporting surface is to be used on a floor or other hard surface, it will be understood that rubber pads or the like can be used for the same purpose. With the stabilizer of the present invention, therefore, it will be seen that a downward force on the mat of the trampoline which would normally tend to bow the rectangular frame downwardly, and move the legs outwardly, will be resisted because the shoes of the stabilizing means will hold the legs in their proper location so that the bowing of the frame will not be possible.

The apparatus of the present invention is simple to construct and is designed for simplicity of manufacture and use.

These and other features and advantages of the present invention will become apparent from consideration of the following specification when taken in conjunction with the accompanying drawings in which.

Figure 1:
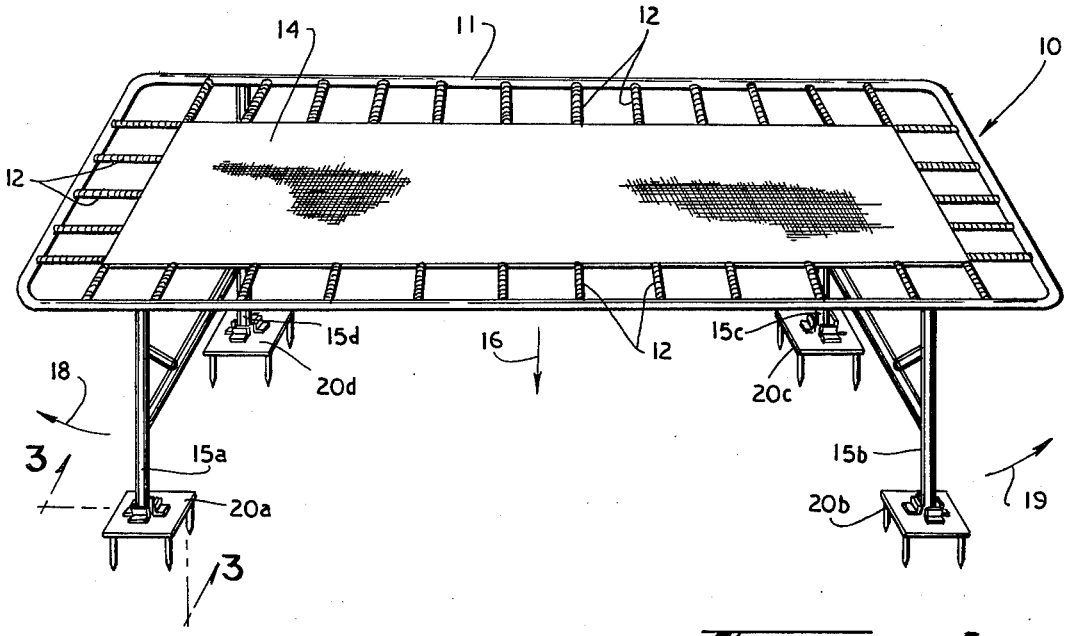
FIG. 1 is a perspective view of a trampoline including stabilizing means made in accordance with the present invention.

Referring now more particularly to the drawings, and to that embodiment of the invention here chosen by way of illustration, FIG. 1 shows a trampoline 10 having a rectangular frame 11 to which is attached a plurality of springs 12. The opposite ends of the springs 12 are fixed to a mat 14. The frame 11 is supported by a plurality of legs, here shown as legs **15*a*, 15*b*, 15*c* and 15*d*. As will be readily seen from the drawing, when a large force is placed against the frame 11 substantially centrally of the legs 15*a* and 15*b*, there would normally be nothing to prevent the flexing or bowing of the frame 11 apart from the strength of the frame itself; and, since the expanse between the legs 15*a* and 15*b*** is relatively long it would be difficult to obtain very great strength because the strength is inversely proportional to the length of the span.

To illustrate the function of the present invention, there is an arrow 16 in FIG. 1 to indicate the direction of force that would be against the mat 14 of the trampoline 10. This force, indicated by the arrow 16, would be resisted at the outer ends of the frame 11 by the legs **15*a* and 15*b* on one end thereof and 15*b* and 15*c* on the opposite end thereof; however, the center portion of the frame 11 would tend to move downwardly so that the frame 11 would assume a bowed condition. It will be understood, however, that the legs 15 of the trampoline 10 are fixed to the frame 11 substantially rigidly so that, when the frame 11 is bowed, the legs 15 will still be substantially perpendicular to the portion of the frame to which they are attached. As a result, the legs 15*a* and 15*b* will tend to move outwardly as shown by the arrows 18 and 19 for the legs 15*a* and 15*b* respectively. Now, it will be understood that during use of the trampoline, the force indicated by the arrow 16 will be a cyclic force, so that the motion of the legs 15 of the trampoline 10 will be an oscillatory movement. That is to say, when the person using the trampoline engages the mat 14, the legs 15 will move outwardly as indicated by the arrows 18 and 19; then, when the person using the trampoline bounces upwardly from the mat 14, the natural resiliency of the frame 11 will cause the frame 11 to return to its straight position and cause the legs 15 to move inwardly in the reverse direction of the arrows 18 and 19. It is this cyclic motion that causes the legs 15 to dig into the surface on which they are resting, and it is the cyclic motion of the frame 11** that causes a weakening of the metal or other material from which the frame is made.

Figure 2:
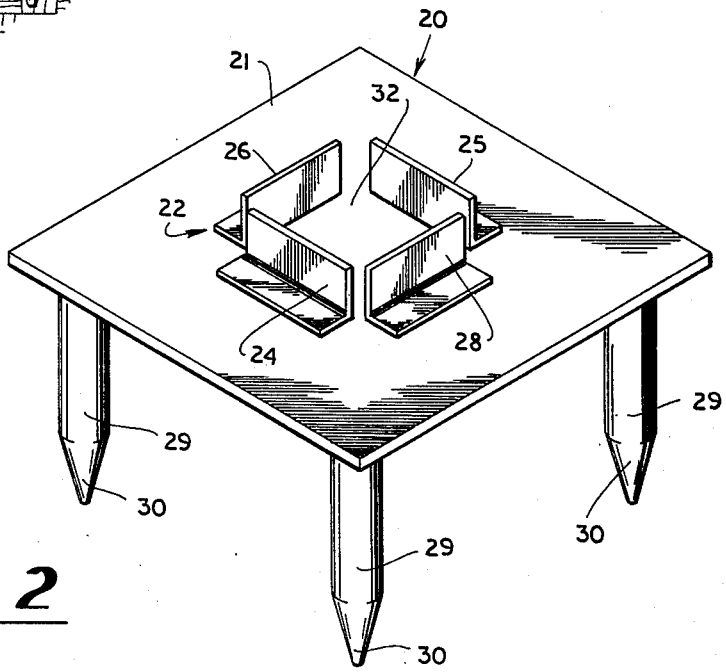
FIG. 2 is a perspective view of a shoe for the stabilizing means as shown in FIG. 1; and, FIG. 3 is an enlarged cross-sectional view taken substantially along the line 3—3 in FIG. 1.

Referring now primarily to FIG. 2 of the drawings, it will be understood that the stabilizing device, or shoe, 20 shown in FIG. 2 is the same as the four devices **20*a*, 20*b*, 20*c* and 20*d* at the end of the legs 15*a*, 15*b*, 15*c* and 15*d* of the trampoline 10 in FIG. 1, each of the devices being substantially identical to the device shown in FIG. 2** of the drawings.

The shoe 20 comprises a substantially square supporting plate 21 formed of a substantially rigid material such as steel plate. It should be understood that a material having relatively high strength must be used for the supporting plate 21 because the legs 15 of the trampoline 10 will be resting substantially at the center of the plate 21 and, as will be better understood hereinafter, it is important that the plate 21 not be bendable or otherwise deformable.

Centrally of the supporting plate 21, there is a retaining means generally designated at 22, the retaining means 22 including a first pair of opposed parallel stops 24 and 25 and a second pair of opposed parallel stops 26 and 28. The four stops 24, 25, 26 and 28 define substantially a square, though it will be understood that other shapes may be defined by the retaining means since the object is to receive a leg of the trampoline 10. It will be seen from the drawings that the stops comprise a flange fixed to the supporting plate, the flanges being sufficient to prevent movement of the foot 31 of the trampoline.

Depending from the plates 21, there is a plurality of anchoring means, the anchoring means being here shown as a plurality of spikes 29. Each of the spikes 29 is fixed to the bottom of the plate 21 and extends substantially perpendicularly downwardly therefrom to terminate in a point 30.

Figure 3:
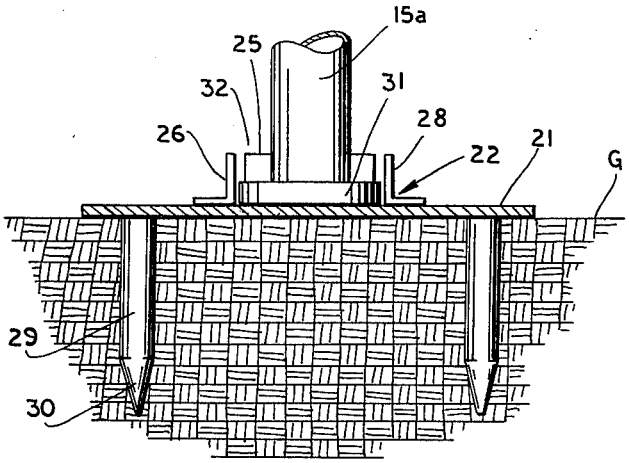

Referring now to FIG. 3 of the drawings, it will be seen that the leg 15*a* of the trampoline 10 has a foot 31 at the lowermost end thereof. The foot 31 is here indicated as being substantially square, but it will be understood that this particular shape is by way of illustration only and the foot 31 may come in virtually any shape that the manufacturer of the trampoline desires to make. This foot 31 is placed in the space 32 that is defined by the flanges that constitute the retaining means 22; and, it will here be seen that the space 32 is substantially in the middle of the supporting plate 21.

As illustrated in FIG. 3 of the drawings, the trampoline 10 is placed on the ground indicated at G so that the supporting plate 21 is flat against the ground G, and the spikes 29 extend downwardly from the plate 21 to project into the ground. In view of this construction, it will be seen that the spikes 29 extend well into the ground G so that the plate 21 to which the spikes 29 are attached cannot move along the ground G. Then, the retaining means 22 defines the space 32 that is only slightly larger than the foot 31 on the leg 15*a*, so there is no appreciable movement between the leg 15*a* and the plate 21.

From the foregoing, it should be understood that, in order to use the stabilizing means of the present invention, the location for the trampoline should first be determined, and the location of each of the legs 15*a*, 15*b*, 15*c* and 15*d* should be determined. Next, a shoe 20 should be placed on the ground where the first leg is to rest, and the device should be simply urged downwardly so that the spikes 29 are forced into the ground G. The pointed end 30 of the spikes 29 will assist in urging the spike 29 into the ground, but it is important to note that the point 30 is so shaped that the earth will be simply moved outwardly and packed rather than being removed so that a well-packed hole in the ground will be formed the same size as the spike 29. The apparatus 20 would of course be appropriately placed for each of the four legs of the trampoline, then the trampoline 10 would be placed with one of the feet 31 in each of the spaces 32. With the trampoline 10 thus installed, when there is a downward force on the trampoline 10 that tends to urge the legs 15 outwardly, it will be understood that the foot 31 on the leg will bear against the flanges of the retaining means 22 so that the foot 31 cannot move relative to the supporting plate 21; furthermore, the spikes 29 are well engaged with the ground G so that the supporting plate 21 cannot move relative to the ground G.

It will also be understood that, in the event the device is to be used on a floor or the like, a non-skid pad made of rubber or the like can be used in lieu of the spikes 29 both to prevent damage to the floor and to stabilize the trampoline 10 as described above.

It will therefore be understood by those skilled in the art that the particular embodiment of the invention here chosen is by way of illustration only, and is meant to be in no way restrictive; therefore, numerous changes and modifications may be made, and the full use of equivalents resorted to, without departing from the spirit or scope of the invention as defined in the appended claims.

I claim:

1. A trampoline comprising a frame, a plurality of legs supporting said frame, a mat carried within said frame, and stablizing means comprising a plurality of stabilizing shoes, each including a supporting plate, retaining means fixed to said supporting plate for slidably receiving one of said plurality of legs and for preventing lateral motion of said leg in any direction with respect to said supporting plate, and anchoring means fixed to said supporting plate and slidably insertable into a supporting surface for preventing lateral motion of said supporting plate with respect to any of a plurality of locations wherein said stabilizing shoe may be inserted, each of said plurality of legs having a foot at the lower end thereof, said retaining means comprising a first pair of substantially parallel stops engaging opposite sides of said foot and a second pair of substantially parallel stops arranged substantially perpendicular to said first pair of stops, and second pair of stops engaging opposite sides of said foot.

2. A trampoline as claimed in claim 1, said anchoring means comprising a plurality of spikes depending from said supporting plate, each of said plurality of spikes being fixed to said supporting plate substantially perpendicularly thereto and including a point at the extending end thereof.

* * * * *